United States Patent [19]

Bridwell

[11] 4,268,927

[45] May 26, 1981

[54] COMBINATION TOOL

[76] Inventor: Phillip P. Bridwell, R.R. #1, P.O. Box 535, Anna, Ill. 62906

[21] Appl. No.: 14,969

[22] Filed: Feb. 26, 1979

[51] Int. Cl.[3] ..... B26B 9/02; B26F 1/00

[52] U.S. Cl. ..... 7/143; 30/367; 145/46; 145/29 R; 145/62

[58] Field of Search ..... 7/143; 30/367; 145/46, 145/29 R, 62

[56] References Cited

U.S. PATENT DOCUMENTS

| | | | |
|---|---|---|---|
| 102,677 | 5/1870 | Gregory | 7/143 |
| 623,792 | 4/1899 | Lans | 145/64 |
| 1,109,507 | 9/1914 | Bostock | 145/62 |
| 1,458,961 | 6/1923 | Williams | 145/46 |
| 1,712,343 | 5/1929 | Gerhardt | 145/62 |
| 2,384,707 | 9/1945 | Sweet | 30/367 |
| 2,675,079 | 4/1954 | Hughes | 30/367 |
| 3,119,424 | 1/1964 | Henry | 7/143 |
| 3,172,204 | 3/1965 | Frey | 30/367 |

FOREIGN PATENT DOCUMENTS

| | | | |
|---|---|---|---|
| 513014 | 11/1930 | Fed. Rep. of Germany | 7/143 |
| 622384 | 5/1927 | France | 7/143 |
| 1081907 | 12/1954 | France | 7/143 |
| 593548 | 10/1947 | United Kingdom | 7/143 |
| 1504865 | 3/1978 | United Kingdom | 145/62 |

*Primary Examiner*—Nicholas P. Godici
*Assistant Examiner*—J. T. Zatarga
*Attorney, Agent, or Firm*—Gust, Irish, Jeffers & Hoffman

[57] ABSTRACT

A combination hammer, impact device, and screw driver has an elongated cylinder formed in the hammer handle in which is reciprocably carried a drive piston, spring urged under the force of a heavy spring, toward the open cylinder end at the base of the handle opposite the hammer head. The spring is adjustably preloaded for corresponding adjustable impact forces, compressed and then released to drive the piston in an outward direction after a predetermined inward movement of an impact piston, also reciprocably carried by the cylinder and extendable from the handle base. The impact piston carries a removable impact tool. The impact tools and the adjustment member for the spring preload are color coded to obtain proper matching of the impact force and tool. A hexagonal recess is formed in the hammer head in substantial longitudinal alignment with the handle with a magnet being secured in the bottom of the recess. Screw driving inserts, having hexagonal bases, are closely fittable in the recess and removably retained therein by the magnet. Storage is provided in the handle for the tools and drivers.

10 Claims, 14 Drawing Figures

COMBINATION TOOL

BACKGROUND OF THE INVENTION

1. Field of the Invention

This invention relates to combination tools and in particular to a hammer having an impact mechanism for nail setting and for driving screws.

2. Description of the Prior Art

Numerous tools exist in the prior art providing more than one function and having storable tool parts in the tool body in an effort to economize in tool expense and size, and further to make tool use more convenient by providing related tools, such as a hammer and nail set, a hammer and measuring gauge, hammers and screw driver, a hammer and nail lubricant, and the like. U.S. Patents disclosing devices exemplary of the prior art include the following: Nos. 3,119,424; 1,417,725; 1,317,048; 1,109,507; 1,059,883; 102,677; 1,419,567; 3,119,423; 1,727,904; 722,899; 896,121; 1,142,946; and 1,643,433.

However, despite the age of the art, and the numerous efforts made to provide the art with combination tools having a combination of functions to provide a convenience that will increase work efficiency, none provide an impact mechanism in combination with a hammer handle which will provide a nail set function operable solely by one-handed handle manipulation without the need for separately holding a nail set and impacting the nail set with the hammer head. Further, no hammer-screw driver combination provides a screw driver tool mounted in the hammer head, which provides simplicity, removability and durable rigidity in the driving connection therebetween.

SUMMARY OF THE INVENTION

A conventional hammer handle is provided with an impact mechanism to which is removably attached a nail set tool, extending from the handle base opposite the hammer head. The nail set tool is placed on the spot where the nail is to be driven, and with a one-handed grasp of the handle, and handle movement toward the work surface a predetermined distance, the mechanism is actuated causing the nail set tool to be driven into the work surface. Further, storage means are provided in the handle for removable storage of a plurality of nail set tools for different size nails. The impact mechanism is adjustable to provide a proportionately heavier impact force when used with a larger nail set tool. The adjustment setting of the impact mechanism may be determined by color coded bands on the portion of the impact mechanism extending from the handle and each nail set tool is also color coded to match the color-coding for the respective impact force setting for that tool so that the proper tool is used with a force setting. Other coding schemes, such as corresponding numerals, letters and symbols on the tools and impact mechanism may also be used.

The impact mechanism comprises a threadedly engaged elongated cylinder and a cap inserted into and secured in an elongated cylindrical passage formed in the handle. The cylinder is rotatably and longitudinally movable in the passage and extends from the base of the handle and may be threaded into or out of the cap. The cylinder is provided with axially spaced color coded bands which become successively visible as the cylinder is threaded outwardly from the handle base.

A drive piston having a conically tapered end is is mounted in the cylinder for reciprocable inward movement toward the hammer head and outward movement toward the handle base and is urged by a heavy coil spring in the outward direction. A cam ring is affixed intermediately of the cylinder and provides a seat for the tapered end of the piston when it is in its fully outward position. The tapered end of the piston is provided centrally with an axial recess having a diameter less than the inside diameter of the ring.

The outward end of the cylinder is provided with an annular seat for receiving an annular rim of an impact piston reciprocably mounted in said cylinder and extendable through the opening of the annular seat. The outward end of the impact piston threadedly receives a desired nail set tool.

An elongated spindle has a tapered section formed intermediately thereof and has a spherical head seated in a spherical indentation in the inward end of the impact piston to provide swiveled movement relative thereto. A second relatively light coil spring is placed between the impact piston and the cam ring to urge the piston rim towards the annular seat, in which position the inward spindle end is cocked against the inner surface of the cam ring engaging the edge of the recess of the drive piston. It should be noted that this impact mechanism has been used in the past in center punches, for example.

Thus, with a one-handed grasp of the hammer handle, and placement of the nail set in the desired position, movement of the hammer handle toward the work surface will lift the annular rim off its seat and urge the spindle inwardly toward the cam ring until the spindle tapered surface engages the inner surface of the cam ring swiveling the spindle to a substantially axially aligned position. During the movement of the hammer handle towards the work surface, the spindle engages the recess edge forcing the drive piston inwardly against the heavy coil spring. When the spindle is moved by the camming action of the tapered surface against the cam ring to a substantially axial position, the inward spindle end is moved off the recess edge and becomes aligned with the recess whereupon the drive spring will suddenly cause the drive piston to move axially outwardly a distance equal to the axial length of the recess imparting a substantially heavy impact force to the spindle and the impact piston driving the nail set into the work surface.

By threadedly turning the cylinder relative the threaded cap, the preload on the drive spring can be correspondingly increased or decreased. Axially spaced color coded bands are provided on the impact piston and become successively visible as the cylinder is threaded outwardly from the cap, with the nearest color coded band to the handle base indicating the drive spring preload. The removable nail set tools are also color coded and the cylinder is axially adjusted in the cap so that the first visible band matches the color on the nail set tool to be used, thus providing the proper impact force for that nail set tool. The smaller the nail set tool, the lesser force is required. Also, an awl tool and a punch tool may be removably attached to the outward end of the impact piston for operation by the impact mechanism.

Storage for the impact tools is provided in the hammer handle both by a longitudinal passage substantially parallel to the cylindrical passage, having a slidable elongated flexible tray which is slidable outwardly from the handle base to provide access to the desired impact tool. Also, a series of axially spaced recesses may be formed in a handle side, each recess to house an impact or other tool, with a slidable cover in the handle to expose the desired tool for removal or insertion. Magnetic inserts are secured in the bottom of each recess to removably retain the tool in the recess.

Also, a hexagonal recess is formed in a side of the hammer head which is opposite to the handle base to receive hexagonal bases of screw driving tools. A magnetic insert is secured in the bottom of the head recess to removably retain the screw driving tool in the head. The screw driving tools may also be stored in the hammer handle.

It is therefore an object of this invention to provide a combination hammer and impact mechanism.

Another object of this invention is to provide an impact mechanism in the handle of the hammer which is operable by a one-handed grasp of the handle and movement of the handle towards the work surface a predetermined distance to automatically place an impact force on an impact tool.

A further object of this invention is to provide a manually adjustable impact force to the impact mechanism.

A still further object of this invention is to provide color coding to the impact mechanism and the impact tool to provide the proper force to be used with a respective tool.

A further object of this invention is to provide in a combination of the above objects, a screw driving tool in the hammer head.

Another object of this invention is to provide in the combination tool of the previous objects storage means in the handle for the impact and screw driving tools.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 4:
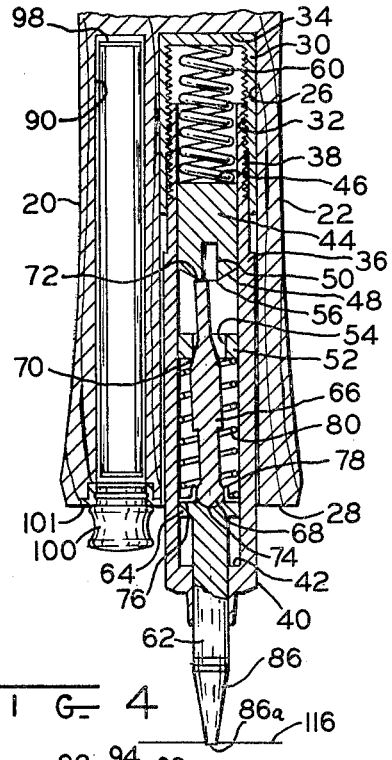
FIG. 4 is a section similar to the section in FIG. 3 with the impact mechanism shown in a second position.
Figure 1:
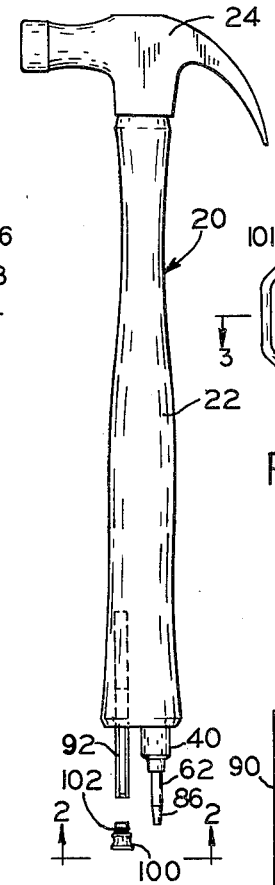
FIG. 1 is a side elevational view of a preferred embodiment of this invention with the storage tray and cap in partially removed and disassembled position.
Figure 2:
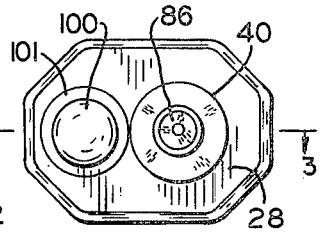
FIG. 2 is an enlarged bottom plan view taken at 2—2 at FIG. 1.

Referring to the drawings, FIGS. 1–5, a hammer 20 having an elongated handle 22, made of wood or other suitable material, with a metal hammer head 24 affixed to one end thereof, has a cylindrical passage 26 formed in the other or base end 28. A cylindrical cap 30 internally threaded at 32 is secured to the inward end 34 of passage 26. An elongated cylinder 36 threaded at the inward end 38 is in threaded engagement with cap 30 and is rotatable in passage 26. The outward end 40 of cylinder 36 extends outwardly of the opening defined by passage 26 in end 28. A radially inwardly extending annular step 42 is formed at the lower or inward end 40. Thus, manual rotation of end 40 will, due to the threaded engagement between cylinder 36 and cap 30, vary the relative axial position therebetween.

A drive piston 44 has an inward end 46 and an outward conically tapered end 48 in which is centrally formed a recess 50. A cam ring 52 is affixed to the inner wall of cylinder 36 and has a central opening 54 formed therein having a diameter larger than the diameter of recess 50, so that the edge 56 formed by recess 50 with surface 48 extends into opening 54, FIG. 3, when piston 44 is in its outwardmost position. A heavy compression coil spring 60 is placed between end 34 of cap 30 and end 46 of piston 44 urging it in an outward, downward as shown in FIG. 3, position.

Figure 3:
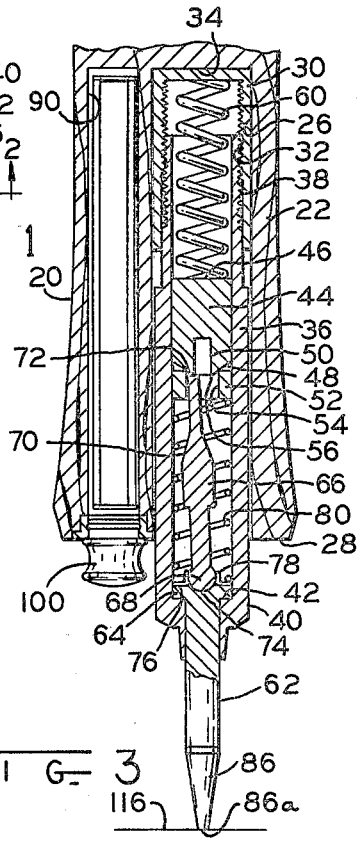
FIG. 3 is an enlarged partial section taken at 3—3 of FIG. 2 showing the impact mechanism in a first position.
Figure 7:
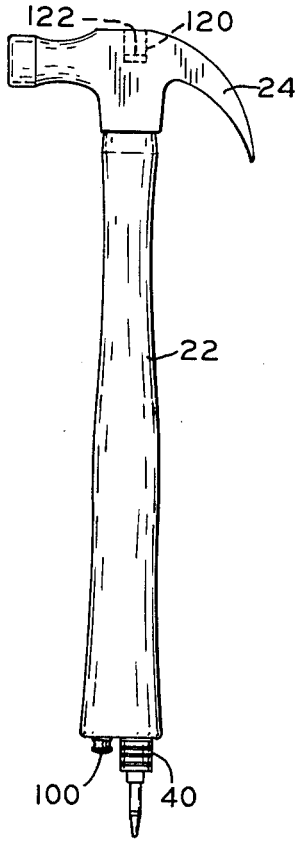
FIG. 7 is a side elevational view showing provision for a screw driving tool in the hammer head.

An impact member or piston 62 is reciprocably mounted in cylinder 36 and has formed at the inward end thereof an annular lip 64 which seats on step 42 in the outwardmost position of piston 62, to restrict further outward movement, FIG. 3. An elongated spindle 66 having a spherical outward end 68 is tapered at 70 intermediately of its length and has an inward end 72 which is engageable with edge 56 when both pistons 44 and 62 are in their outwardmost positions, FIG. 3, and spindle 66 is angularly cocked to the longitudinal axis of cylinder 36. A spherical indentation 74 is formed on the surface of the inward end of piston 62 and swivelly supports for free swiveling movement end 68 of spindle 66. A washer 76 is seated on the inward end of piston 62 and has formed centrally thereof an inwardly extending spherically shaped annular lip 78 for swivelly retaining end 68 in identation 74. A light coil compression spring 80 is placed about spindle 66 and has its inward end abutting the surface of the outward end of ring 52 and its outward end abutting washer 76. The outward end of piston 62 is internally threaded at 82, FIG. 5, for threadedly receiving the threaded stub 84 of an impact tool 86, which may be an awl, punch, or a nail set. Spindle 66 is inherently unbalanced, due to the swivel relationship between end 68 and indentation 74, and will, in the outward positions of pistons 44 and 62 as shown in FIG. 3, assume an inclined position to the longitudinal axis so that end 72 will always abut edge 56. Preferably cap 30, cylinder 36, piston 44, 62, spindle 66, and the tools are of a metallic material.

Figure 5:
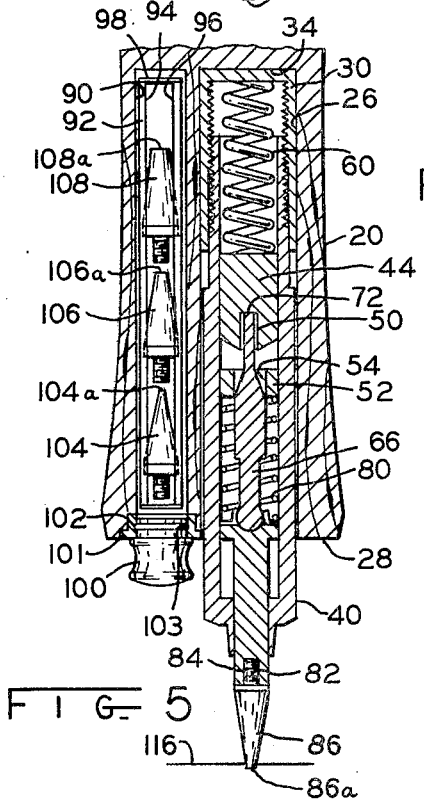
FIG. 5 is a section similar to that in FIG. 3 with the impact mechanism shown in a third position.

A second elongated passage 90, FIGS. 3–5, is formed in handle 20 and is substantially parallel to passage 26 and laterally spaced therefrom. An elongated tray 92 having flexible sidewalls 94, 96 and end 98 is slidably insertable in passage 90, with walls 94, 96 conformable to walls of passage 90. A knob plug 100 is removably insertable in grommet 101 affixed in handle 20 at the base of passage 90 and has a ring 102 snappable into groove 103 of grommet 101 to releasably retain tray 90 in its fully inserted position. Plug 100 in its inserted position extends outwardly from end 28 and is manually accessible.

Referring to FIG. 5, a plurality of nail set tools 104, 106, 108 are placed and stored end to end in tray 92 with plug 100 retaining the tools in place.

Figure 6:
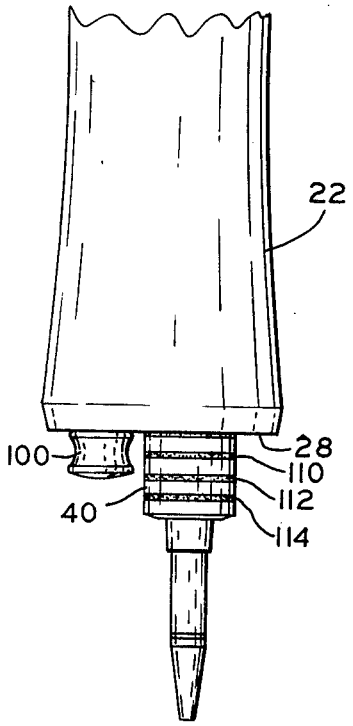
FIG. 6 is an enlarged partial side elevational view of the embodiment of FIG. 1.
Figure 8:
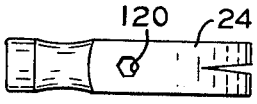
FIG. 8 is a top plan view of the embodiment of FIG. 7.
Figure 9:
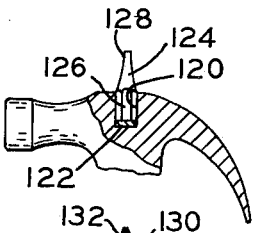
FIG. 9 is a partial side elevational view broken away having a first screw driving tool inserted therein.
Figure 10:
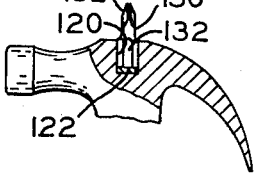
FIG. 10 is a view similar to FIG. 9 showing a second screw driving tool inserted therein.

Referring to FIG. 6, outward end 40 of cylinder 36 has axially spaced circumferential color coded bands 110, 112, and 114. In the disclosed embodiment, band 110 may be green, band 112 may be red, and band 114 may be blue. As will become apparent, the first visible band outwardly of end 28 will indicate the preload on spring 60 and when the first visible band is band 110, the lowest preload is on spring 60, band 112 indicates an intermediate preload, and band 114 indicates the highest preload. Tools 104, 106, and 108, are also color coded with nail set tool 104 being green, tool 106 being red, and tool 108 being blue. The respective ends 104*a*, 106*a* and 108*a* of tools 104, 106 and 108 are of increasingly larger diameter to provide nail sets for increasingly heavier nails such as 6 pennyweight, 8 pennyweight, and 10 pennyweight nails respectively. Also, as will become apparent, as the preload of spring 60 is increased, the impact force generated to the tools mounted in piston 62 will be increased so that the nail set tool for the larger nail will have a proportionately higher impact force imparted thereto.

In the operation of the embodiment shown in FIGS. 1–6, a nail set tool for the respective size nail to be set is threadedly attached to the outward end of piston 62. Then, end 40 of cylinder 36, which may be knurled for manual gripping and rotating, is manually rotated until the first visible band adjacent end 28 has the same color as the color of the tool 86. For example, if tool 86 is green, then end 40 is rotated until the green band is placed just outwardly of end 28. This will effect a predetermined relative axial position between cap 30 and cylinder 36, compressing spring 60 by a corresponding predetermined degree. In the initial position, FIG. 3, spindle 66 is cocked toward and bears against surface 54 of ring 52 with end 72 engaging edge 56 of piston 44. The end 86*a* of tool 86 is then placed at that point on work surface 116 wherein a nail set is desired. Handle 20 is manually grasped and moved towards surface 116 moving piston 62, spindle 66, and piston 44 in an inward direction compressing springs 80 and 60 as shown in FIG. 4. Handle 20 is continued in its movement towards surface 116 with spindle 66 moving inwardly through cam ring 52 with tapered surface 70 engaging the outward edge of opening 54 camming spindle 66 toward a substantially longitudinal or axial position, FIG. 5, until end 72 becomes substantially aligned with opening 50 whereupon piston 44, under the pressure of spring 60, will be triggered and suddenly move outwardly a distance equal to the axial length of recess 50 until the bottom of recess 50 impacts against end 72 of spindle 66. The force of spring 60 and the inertia of piston 44 will then provide a sudden and forceful impact to spindle 66, piston 62, and tool 86, causing a nail set indentation on work surface 116.

Thus, with a single, one-handed movement of handle 20 towards work surface 116, a nail set is accomplished which previously required holding of a nail set tool in one hand and applying an impact, as with a hammer, to the tool with the other hand. Further, the impact mechanism is in the handle of the hammer, which may then be used to drive the nail for which the nail set has been made. Still further, storage is provided in the hammer handle to accommodate a plurality of nail set tools each for a different size nail.

It will be appreciated that as cylinder 36 is threaded into cap 30, the preload on spring 60 will be increased, correspondingly increasing the impact force. Also, by increasing the axial length of recess 50, the impact for all adjustment settings will be increased and by decreasing the length, the impact force for all adjustment settings will be correspondingly decreased.

Referring to FIGS. 7–10, a recess 120 having a polygonal cross section, in this embodiment a hexagonal cross section, is formed in the side of head 24 opposite the side to which handle 20 is attached. A magnetic insert 122 is secured to the bottom of recess 120. A screw driving tool 124, of a ferrous material having a base 126 with a polygonal cross section matching cross section of recess 120 is inserted in recess 120 and removably retained by magnet 122. Tool 124, FIG. 9, has a blade end 128 while tool 130, FIG. 11, has a Phillips head end 132. Tool 130, also of a ferrous material, has a base 132 of a polygonal cross section matching the cross section of recess 120 and is removably retained in recess 120 by magnet 122. Once tools 128, 130 are inserted in recess 120, they may be applied to a screw head and substantial turning force is available by two-handed grasping of handle 20, to insert or remove a screw. Further, since insert 120 is formed in a metallic hammer head 24, and since tools 128, 130, are metallic, a durably rigid connection is provided.

Figure 11:
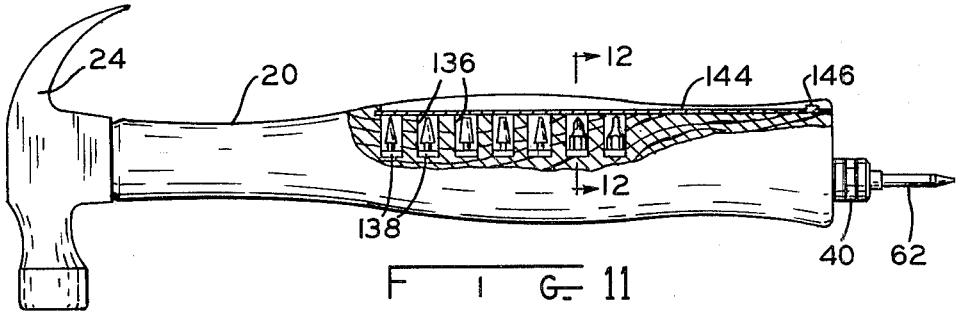
FIG. 11 is a side elevational broken away view of a second embodiment showing an alternate method of storing the tools in the hammer handle.
Figure 12:
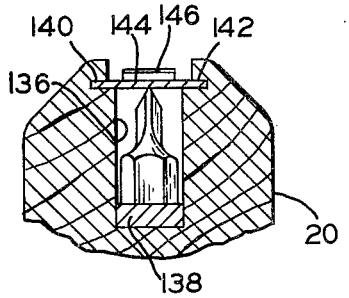
FIG. 12 is an enlarged section taken at 12—12 of FIG. 11.

Referring to FIGS. 11 and 12, an alternate method of storing the usable tools in the hammer handle is shown. A plurality of transverse axially spaced recesses 136, each with a magnet insert 138 secured to the bottom of the recess, are formed along a handle 20 side. Sufficient recesses are formed to accommodate each of the nail set, screw driving, or other tools designed for use with the combination tool. A pair longitudinal grooves 140, 142 are formed in handle 20 on either side of recesses 136 for slidably receiving a cover 144 having a boss 146 at the outer end thereof for aid in finger sliding manipulation of cover 144. Cover 144 in its fully inserted position will positively retain the tools in their respective recesses 136 and may be slidably removed to provide access to the particular desired tool.

Figure 13:
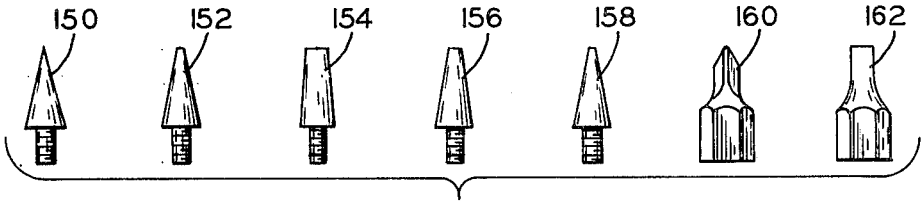
FIG. 13 is a side elevational view of typical tools for use in the embodiments of this invention.

Referring to FIG. 13, various tools usable with this invention are shown. Tools 150–158 each have threaded stubs for threaded insertion in piston 62 of the impact mechanism, tool 150 being an awl, tool 152 being a center punch of hardened steel, and tools 154–158 being nail sets for different size nails. Tools 160, 162 are for use in recess 120, tool 160 being a Phillips head screw driver and tool 162 being a blade type screw driver, and each having a hexagonally shaped base for insertion in recess 120. Preferably, each of the tools 150–162 are of a ferrous material. Also, the adjusted positions of the impact mechanism for the various impact forces and the impact tools to be used with each adjusted position may be matched by other indicia than color coding.

Figure 14:
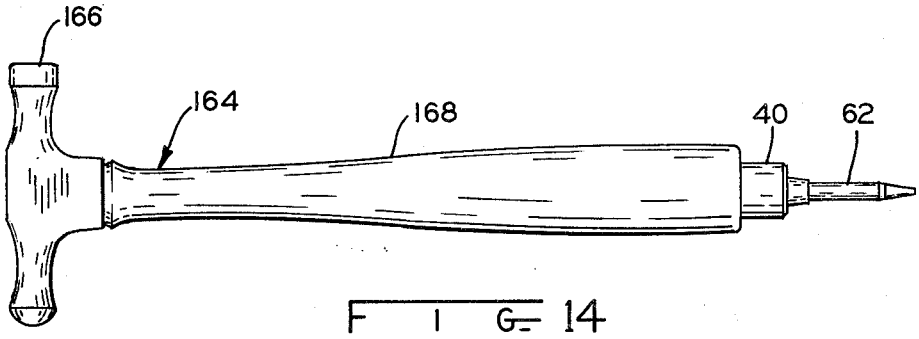
FIG. 14 is a side elevational view of a further embodiment of this invention.

Referring to FIG. 14, a ball peen hammer is shown having an impact mechanism formed in handle 168 similar to that shown for the embodiment disclosed in FIGS. 1 to 5 although it is set for one impact foece and does not have the adjustable impact force feature.

While there have been described above the principles of this invention in connection with specific apparatus, it is to be clearly understood that this description is made only by way of example and not as a limitation to the scope of the invention.

I claim:

1. A tool comprising:

an elongated hammer handle adapted to receive a hammer head at one end and having an elongated cylindrical passage with an opening at the other handle end;

an elongated cylinder member having a cylinder axis and being inserted in said opening;

an impact member reciprocably mounted for inward and outward movement in said cylinder and extendible outwardly from said opening;

impact means mounted in said cylinder for providing a sudden impact force to drive said member outwardly from said opening upon a predetermined inward movement of said member and including adjustment means for providing manual adjustment of the impact force of said impact means, said impact means further comprising a spring loaded drive piston reciprocably mounted in said cylinder, and said adjustment means comprising means for varying the spring preload of said drive piston;

said cylinder member extending outwardly from said other end of said handle by an amount which is related to the preload on said spring;

axially spaced markings on said cylinder member, said markings being successively visible as said cylinder member is threadedly adjusted from said cap outwardly from said other end of said handle;

a plurality of differently marked impact tools each for use with a respective different adjusted position of said cylinder member as indicated by the nearest visible first marking to said other end of said handle; and said impact means having means for releasably retaining an impact tool, whereby by matching the markings of said tools to a respective marking on said cylinder member that is first visible will obtain the proper impact force for each tool.

2. The tool of claim 1 including a second elongated passage in said handle substantially parallel to said cylindrical passage and laterally spaced therefrom, said second passage having an opening at said handle other end, said second passage adapted to store a plurality of impact tools, and a plug removably insertable in said second passage end to retain said impact tools in said second passage.

3. The apparatus of claim 1 including a nail set tool being removably attachable to the outer end of said impact member.

4. The apparatus of claim 1 wherein said adjustment means comprises an internally threaded cylindrical cap secured to the inner end of said cylindrical passage;

the inner end of said cylinder being threadedly engaged with said cap;

means in said cylinder for restraining the outward movement of said piston in a preload position;

a spring being between the inward ends of said piston and said cap;

the relative axial positions of said cap and said cylinder being manually adjustable to vary the preload of said spring.

5. The apparatus of claim 1 including a plurality of parallel cylindrical, longitudinally spaced recesses formed on one side of said handle;

a plurality of ferrous impact tools removably attachable to said impact means;

a magnet being secured in the bottom of each of said recesses to releasably retain an impact tool in a said recess;

a pair of laterally spaced elongated grooves being formed in said handle, a groove being on either side of said longitudinally spaced recesses;

an elongated cover being slidably mounted in said grooves and manually longitudinally slidable to expose said recesses for removal and insertion of said tools from and into said recesses.

6. The apparatus of claim 1 including a center punch tool being removably attachable to the outer end of said impact member.

7. The apparatus of claim 1 including an awl tool being removably attachable to the outer end of said impact member.

8. A tool comprising:

an elongated hammer handle adapted to receive a hammer head at one end and having an elongated cylindrical passage with an opening at the other handle end;

an elongated cylinder having a cylinder axis inserted in said opening;

an impact member reciprocably mounted for inward and outward movement in said cylinder and extendible outwardly from said opening;

impact means being mounted in said cylinder for providing a sudden impact force to drive said member outwardly from said opening upon a predetermined inward movement of said member, said impact means comprising a drive piston reciprocably mounted in said cylinder, spring means for urging said drive piston toward said opening, and trigger means being in said cylinder between said drive piston and said member for moving said piston and compressing said spring means upon inward movement of said member and suddenly releasing said piston for a driving movement of said piston toward said opening under the force of said spring means to drive said member outwardly of said opening;

said trigger means comprising an elongated spindle having a cam taper intermediately formed thereon and having one end engageable with one end of said piston and a second end engageable with one end of said impact member;

said one end of said piston being conically tapered and having a recess formed centrally therein for receiving said one end of said spindle, and having an edge defining the recess opening;

a cam ring affixed intermediately of the length of said cylinder between said piston and member and having an opening centrally thereof for receiving said spindle, said ring opening being substantially larger than the spring diameter so that said spindle is laterally movable in said ring opening;

said ring opening being substantially larger than said recess opening to provide a seat for receiving the tapered end of said drive piston;

said one end of said spindle engageable with the edge of said recess opening when in a laterally cocked position so that upon a predetermined inward movement of said impact member said spindle and piston will be axially moved inwardly against the force of said spring means until said spindle taper engages said cam ring to cam said spindle from a laterally cocked position to a substantially axially aligned position wherein said one end of said spindle becomes axially aligned with said recess, whereupon said drive piston under the force of said spring means will be triggered and will suddenly and forcefully move in an outward direction to drive said spindle and impact member in an outward direction;

said spring means comprising a coil spring mounted in said cylinder between the other end of said piston and the inward end of said passage;

a second coil spring being mounted in said cylinder between said cam ring and said one end of said impact member;

an annular seat being formed radially inwardly of said cylinder at the outward end of said cylinder;

said impact member having an annular lip at the inward end thereof that is urged by said second spring towards engagement with said annular seat, the engagement between said lip and said annular seat restricting outward movement of said member from said cylinder;

said second end of said spindle being spherical;

a spherically shaped indentation being formed in the inward end of said member, said spherical end of said spindle being swivelly seated in said indentation; and a retaining washer being urged by said second spring against said inward end of said member and having a spherically shaped lip bearing against the spherical end of said spindle to swivelly retain said spherical end in swivellable engagement with said indentation.

9. The apparatus of claim 8 including an internally threaded cylindrical cap secured to the inner end of said cylindrical passage;

the inner end of said cylinder being threadedly engaged with said cap; and the preload of said spring means being adjustable by manual threaded axial adjustment of said cap and said cylinder.

10. A tool comprising:

an elongated hammer handle adapted to receive a hammer head at one end and having an elongated cylindrical passage with an opening at the other handle end;

an elongated cylinder having a cylinder axis inserted in said opening;

an impact member reciprocably mounted for inward and outward movement in said cylinder and extendible outwardly from said said opening;

impact means mounted in said cylinder for providing a sudden impact force to drive said member outwardly from said opening upon a predetermined inward movement of said member;

adjustment means cooperating with said impact means for providing manual adjustment of the impact force of said impact means;

said impact means comprising a spring loaded drive piston reciprocably mounted in said cylinder;

said adjustment means comprising means for varying the spring preload of said drive piston;

said cylinder extending outwardly from said other end of said handle by an amount corresponding to the preload of said spring;

axially spaced color bands formed on said cylinder, said bands being successively visible as said cylinder is threadedly adjusted from said cap outwardly from said other end of said handle;

a plurality of color marked impact tools each for use with a respective different adjusted position of said cylinder as indicated by the nearest visible first color band to said other end of said handle; and said impact means having handle means for releasably retaining an impact tool, whereby by matching the color markings of said tools to a respective band that is first visible will obtain the proper impact force for each tool.

* * * * *